US006269054B1

(12) United States Patent
Truini

(10) Patent No.: US 6,269,054 B1
(45) Date of Patent: Jul. 31, 2001

(54) BIO-RHYTHM WRIST WATCH

(76) Inventor: Stefano A. Truini, 285 Central Park West #75, New York, NY (US) 10024

( * ) Notice: Subject to any disclaimer, the term of this patent is extended or adjusted under 35 U.S.C. 154(b) by 0 days.

(21) Appl. No.: 09/071,990

(22) Filed: May 5, 1998

(51) Int. Cl.[7] ..... G04B 19/24; G04B 19/00

(52) U.S. Cl. ..... 368/29; 368/223

(58) Field of Search ..... 368/10, 28, 29, 368/40, 43, 76, 80, 223; 364/413, 413.01, 413.02, 413.03, 413.05

(56) References Cited

U.S. PATENT DOCUMENTS

| | | | | |
|---|---|---|---|---|
| 4,059,952 | * | 11/1977 | Kaesther . | |
| 4,101,962 | * | 7/1978 | Hakata | 364/413 |
| 4,184,202 | * | 1/1980 | McCrae | 364/413 |
| 4,240,153 | * | 12/1980 | Merritt | 368/28 |
| 5,638,341 | * | 6/1997 | Amano | 368/223 |
| 5,659,521 | * | 8/1997 | Amano | 368/70 |

* cited by examiner

*Primary Examiner*—Vit Miska

(57) ABSTRACT

A wrist-watch having an LCD and/or an analog display wherein the time and/or other time references are displayed and wherein changes in position of Bio-rhythm cycles are displayed.

3 Claims, 9 Drawing Sheets

BIO-RHYTHM WRIST WATCH

BACKGROUND OF THE INVENTION

This invention relates to devices which allow indication of temporal changes in various forms other than and including the display of time, and specifically to changes in the Biorhythm cycles of an individual. Bio-rhythms for individuals are calculated starting from an individual's date of birth and are represented by three cycles which oscillate between positive or high periods of activity and negative or low periods of activity where in between is a critical line which defines the border between these two phases. Firstly, the intelligence cycle which lasts for thirty three days involves the intensity and acuteness to which the thought or mental powers of an individual are used. Secondly, the emotional cycle which lasts for twenty eight days relates to the mood or sensitivity that an individual experiences. Thirdly, the physical cycle which lasts for twenty three days relates to the amount of physical body strength an individual feels comfortable expending. Research shows that there is a considerable amount of significance to changes in these three cycles particularly when any of them crosses the critical line, and even more so when more than one cross the critical line at the same time. This has been taken seriously to the extent that various governments have funded research on Bio-rhythms especially as they relate to high risk situations as in aeronautics safety.

DESCRIPTION OF THE BACKGROUND ART

At present a variety of devices for calculating and representing life rhythms including Biorhythms exist notably:
U.S. Pat. No. 5,638,341; Amano; June 1997
U.S. Pat. No. 4,179,610; Chester; December 1979
U.S. Pat. No. 4,059,952; Kaestner; November 1977
These devices are all designed to facilitate useable access to information regarding life rhythms but none of them incorporate a device in watch form that provides information specific to Bio-rhythm cycles. Because the importance of Bio-rhythms is, in certain cases, strong enough to effect variations in behavior and activity it is believed that a wrist watch which can provide this information will be of service to those who are interested in following the significance of such information with the ease of using a watch.

SUMMARY OF THE INVENTION

The current invention comprehends a conventional type watch device having mechanically driven analog time indicators and/or indicators displayed on a liquid crystal display, with computing circuitry and input buttons which allow for information regarding time, time related information, e.g., date, and the constantly oscillating cycles of Bio-rhythm changes to be displayed and controlled as necessary.

DETAILED DESCRIPTION OF THE DRAWINGS

Description of the First Embodiment

Figure 1:
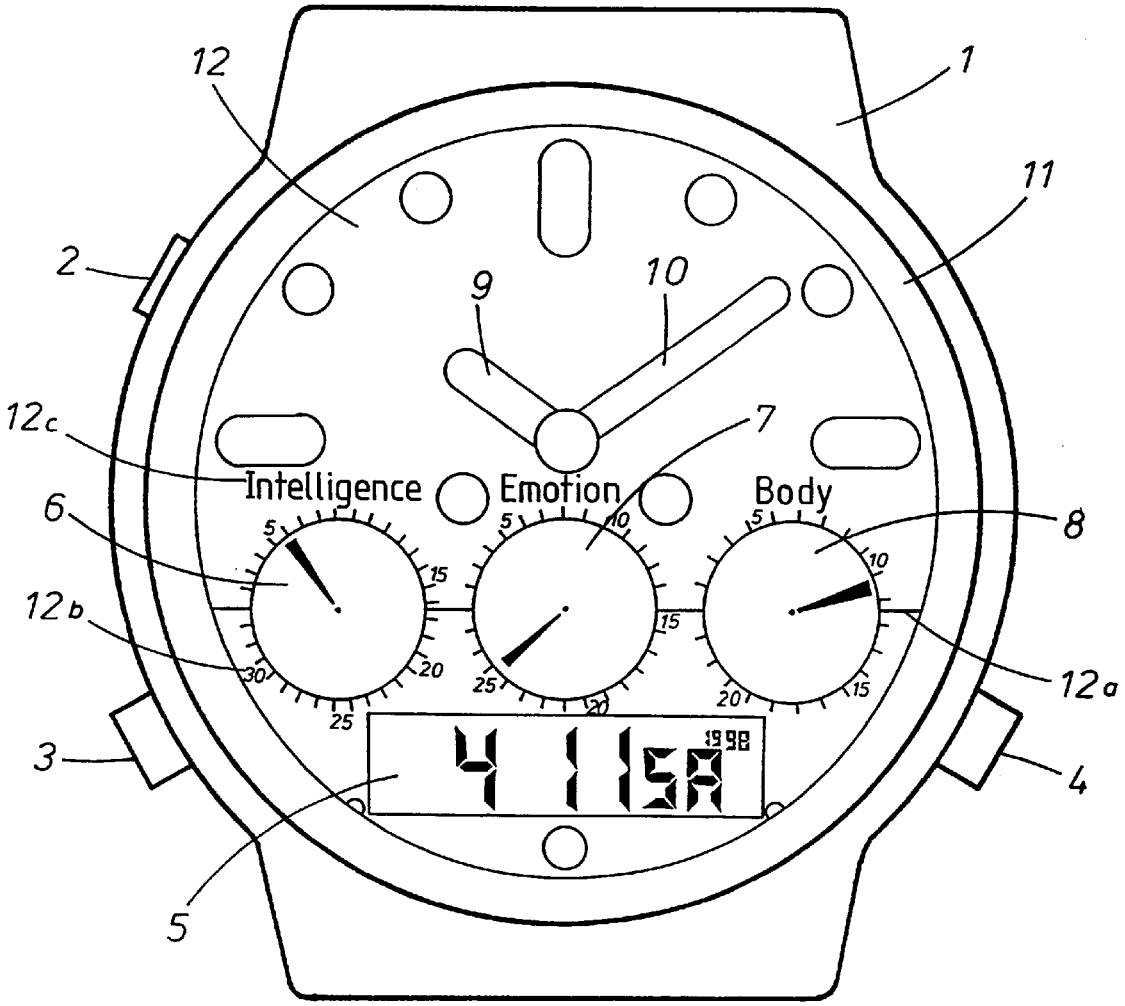
FIG. 1 is a front view of the first embodiment of the invention.

The watch device in FIG. 1 is comprised of a watch case 1 and lens 11 which contain and protect all of the elements necessary for the operation of the device. The device uses an hour hand 9 and minute hand 10 which are driven by a standard analog type quartz movement and are placed eccentric to the center point of the watch base plate 12. Setting of the hands 9,10 is controlled by the time button 2 which when depressed moves the hour hand 9 and the minute hand 10 forward until the desired time is reached. A mode button 4 is used to select the time options available in the liquid crystal display (LCD) area 5. After selecting a time option in LCD area 5 the input button 3 is used to set each of the time options. The time options in LCD area 5 include the time, the day, month, and year, and a date of birth as well as a Bio-rhythm advance function which when selected with mode button 4 enables the three Bio-rhythm is along with the date to be advanced into the future by using input button 3. This last function is important as it allows a user to plan their future schedule as related to Biorhythm activity. When finished with the advance function pressing mode button 4 resets the Bio-rhythm cycles to the current date. In LCD area 5 it is also possible to include time options such as a stop-watch and an alarm setting. In LCD area 6 is displayed the daily position of the Bio-rhythm cycle for intelligence. In LCD area 7 is displayed the daily position of the Bio-rhythm cycle for emotion. In LCD area 8 is displayed the daily position of the Bio-rhythm cycle for the body. The three Bio-rhythm cycles are set by selecting the birth date option with the mode button 4 and by then setting the desired birth date with the input button 3. Critical line 12*a* is used to determine whether a Bio-rhythm cycle is in a positive phase, e.g., day five in LCD area 6 for intelligence, or a negative phase, e.g., day twenty five in LCD area 7 for emotion. On the base plate 12 are printed the critical line 12*a*, numbers 12*b*, and words 12*c* to assist with indication of the Bio-rhythm information.

Figure 2:
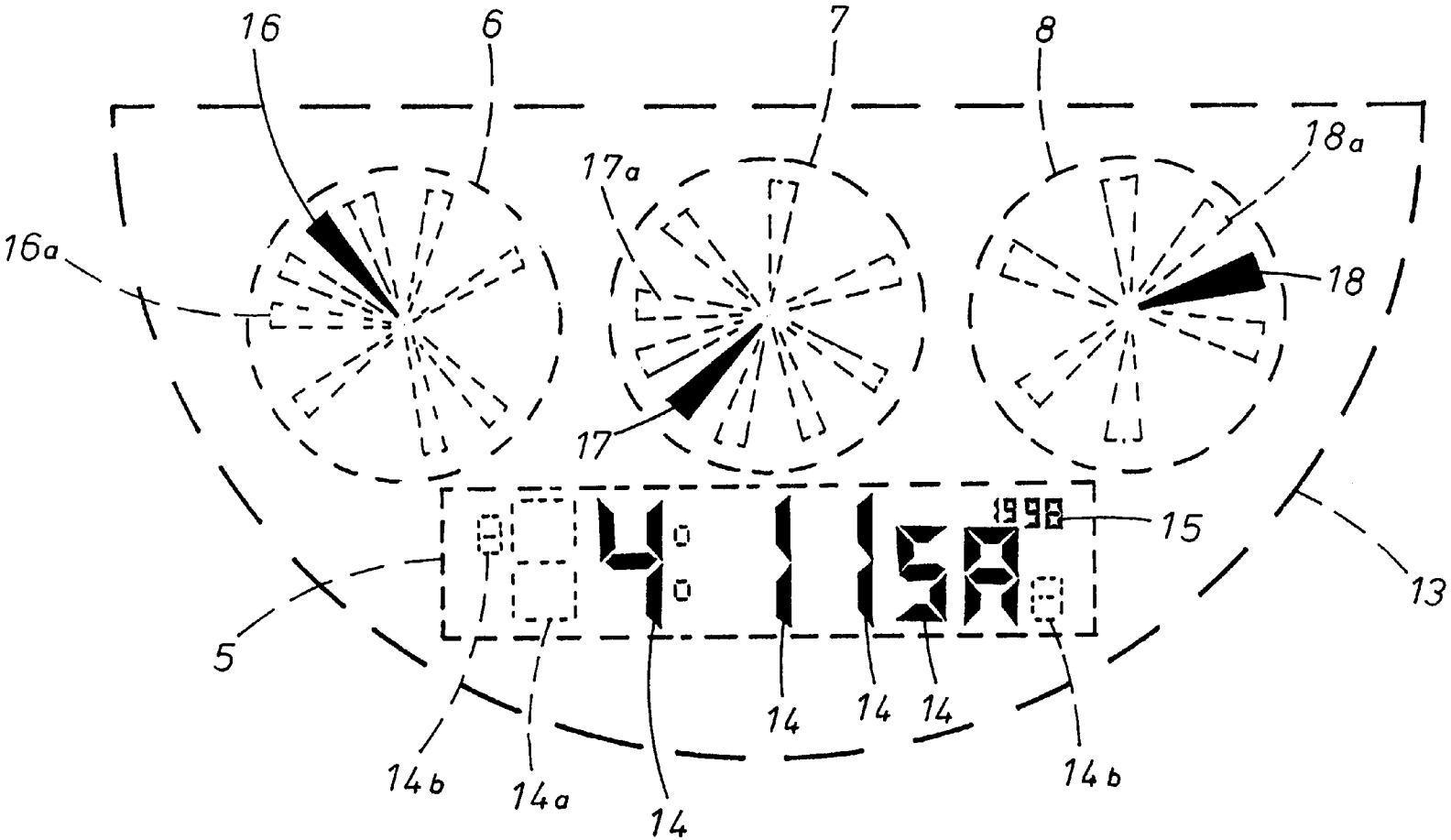
FIG. 2 is a detailed front view of the Bio-rhythm indicating graphic display of the first embodiment of the invention.

FIG. 2 is a detail of the LCD element for the first embodiment contained within the dotted lines 13. In LCD area 5 the date 14 and the year 15 are represented by activated display segments. The dotted lines 14*a* and 14*b* represent inactivated display segments. Inactivated display segments 14*b* are used to indicate AM, PM times and time mode. The display segments in display area 5 are able to display time (not shown), date 14, year 15, the birth date of an individual (not shown), stop-watch (not shown), and alarm clock (not shown). The year 15 is necessary for the calculation of the positions of the Bio-rhythm cycles. In LCD area 6 for the Bio-rhythm cycle for intelligence are contained thirty three display segments (not all represented), one for each day of the cycle where display segment 16 represents an activated display segment and display segment 16*a* represents an inactivated display segment. In ICD area 7 for the Bio-rhythm cycle for emotion are contained twenty eight display segments (not all represented), one for each day of the cycle where display segment 17 represents an activated display segment and display segment 17*a* represents an inactivated display segment. In LCD area 8 for the Bio-rhythm cycle for the body are contained twenty three display segments (not all represented), one for each day of its cycle where display segment 18 represents an activated display segment and display segment 18*a* represents an inactivated display segment.

Figure 3:
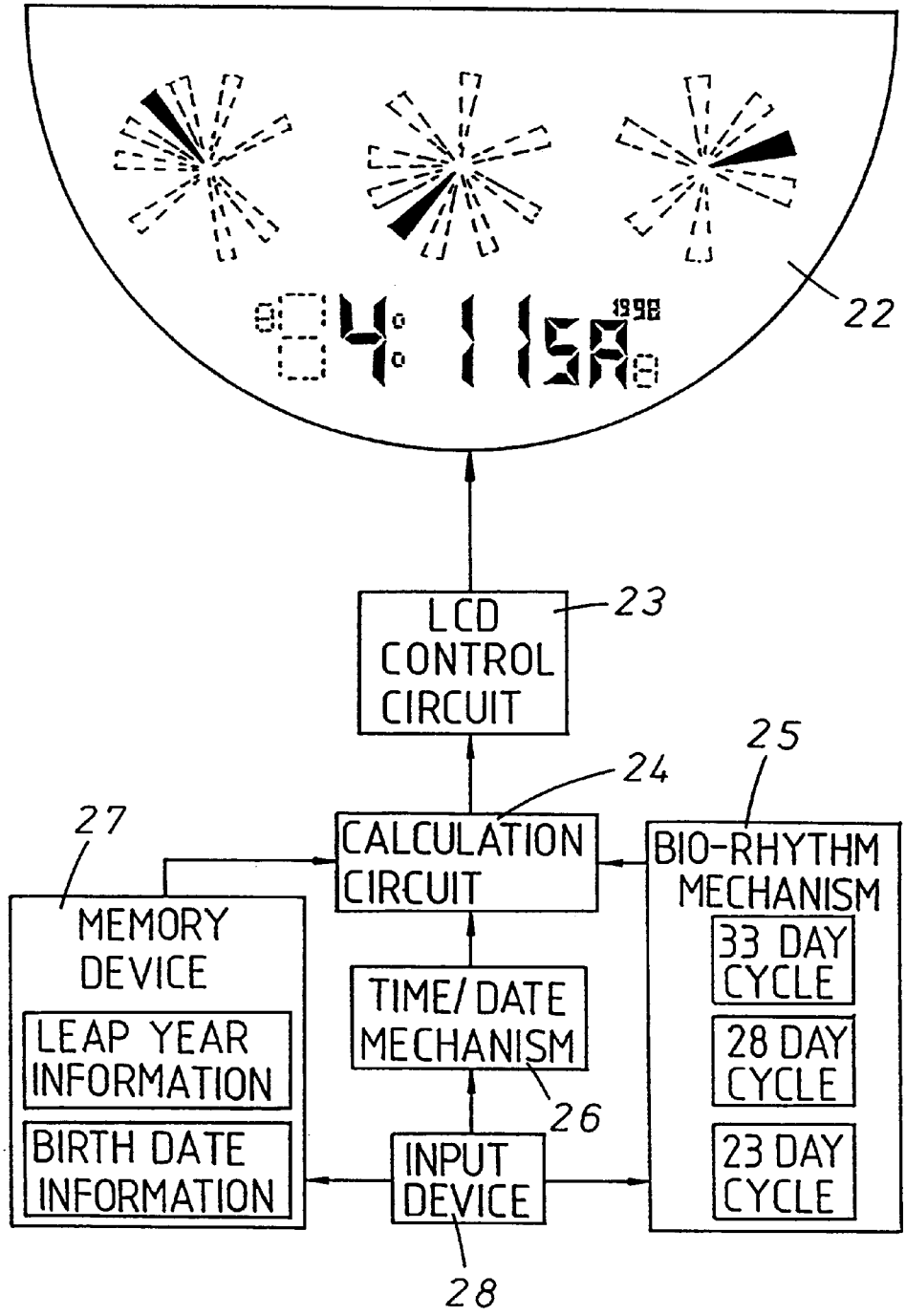
FIG. 3 is a block diagram of the electronics of the Bio-rhythm indicating device.

FIG. 3 shows a block diagram of the electronic circuitry for the first embodiment. The input device 28 which is controlled by the input button 3 of FIG. 1 sends time, date and year information to the time/date mechanism 26 which sends that information to the calculation circuit 24. The input device 28 also sends information regarding the birth date of an individual to the memory device 27 and to the Bio-rhythm mechanism 25. The memory device 27 stores the birth date information and information regarding days of the year, including leap years, all of which is sent to the calculation device 24. Upon inputing a date of birth the Bio-rhythm mechanism 25 sends information regarding a thirty three day cycle, a twenty eight day cycle and a twenty three day cycle to the calculation circuit 24 which then calculates the position of each cycle to the current date based on the birth date information and year and leap year information which it receives from the memory device 27, and the time, date and year information which it receives from the time/date mechanism 26. The calculated information is then sent to the LCD control circuit 23 which activates the appropriate display segments in the LCD unit 22.

Description of the Second Embodiment

Figure 4:
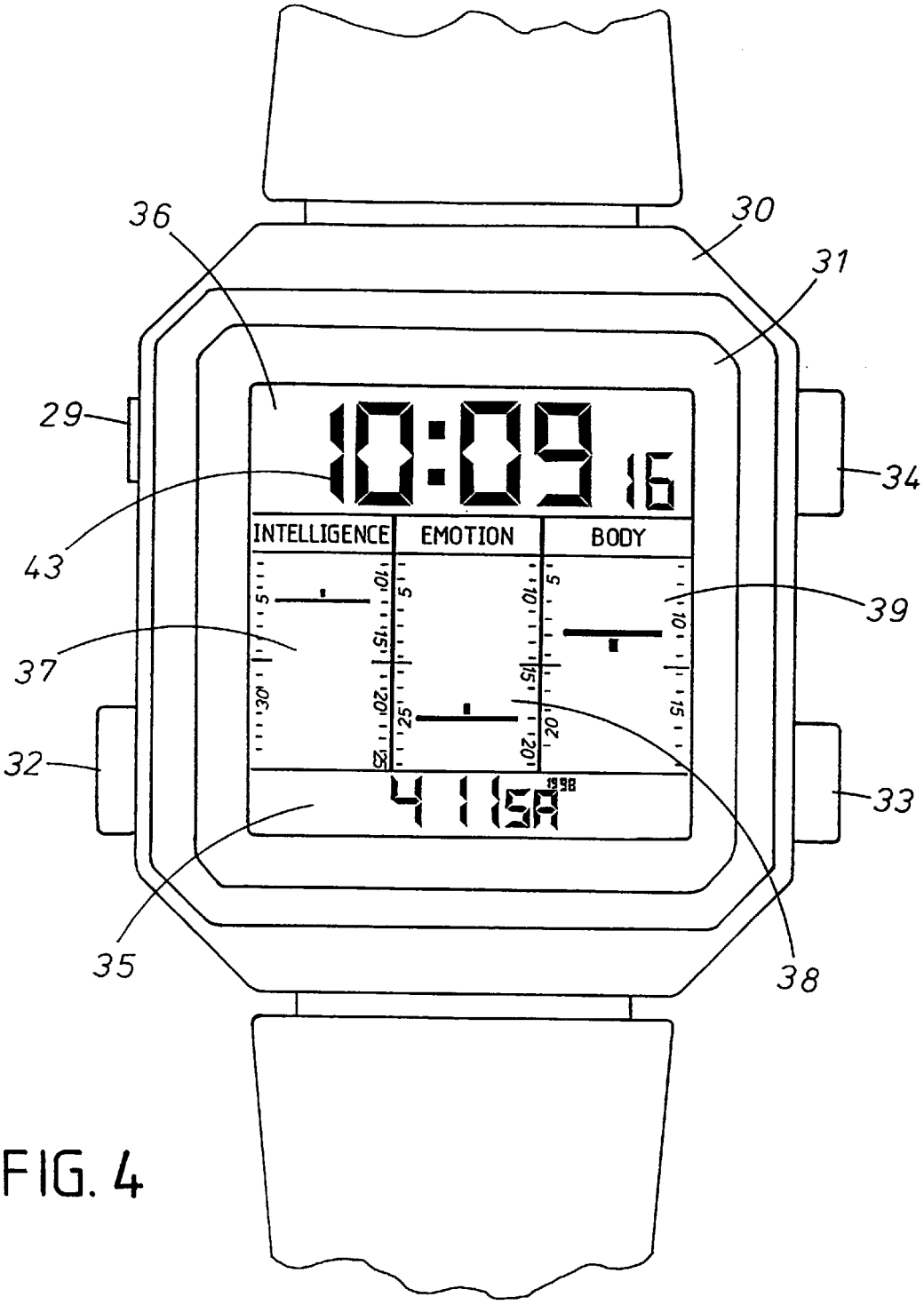
FIG. 4 is a front view of the second embodiment of the invention.

The watch device in FIG. 4 is comprised of a watch case 30 and lens 31. In LCD area 36 the time 43 is represented by activated display segments. Setting the time 43 with input button 34 is possible after the time 43 has been initialized by depressing the time button 29. LCD area 35 contains the same time options, and functions in the same manner, as described in LCD area 5 of FIG. 1 of the first embodiment and is similarly controlled with mode button 33 and input button 32. In LCD area 37 is displayed the daily position of the Biorhythm cycle for intelligence. In LCD area 38 is displayed the daily position of the Biorhythm cycle for emotion. In LCD area 39 is displayed the daily position of the Bio-rhythm cycle for the body. The three Bio-rhythm cycles are set by selecting the birth date option with the mode button 33 and then setting the desired birth date with the input button 32.

Figure 5:
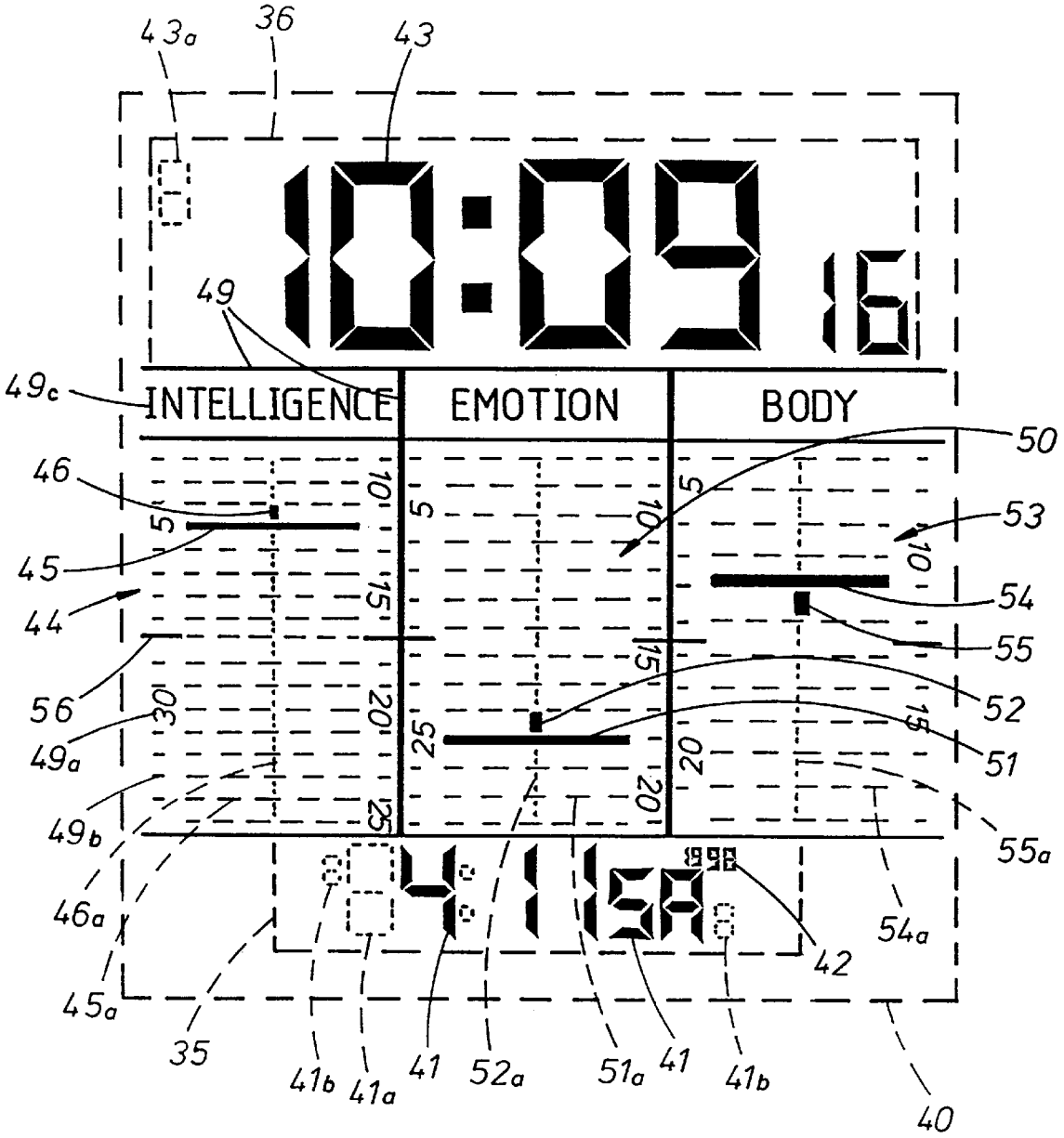
FIG. 5 is a detailed front view of the Bio-rhythm indicating graphic display of the second embodiment of the invention.

FIG. 5 is a detail of the LCD element contained within the dotted lines 40 for the second embodiment. The activated and inactivated display segments 41–42 in LCD area 35 operate in the same way as described above for the display segments 14–15 in area 5 of FIG. 2. LCD area 36 contains time display segments 43–43*a* which are used to tell the time. In LCD area 44 for the Bio-rhythm cycle for intelligence are contained seventeen horizontal display bars 4545*a* which are used to indicate the daily position of the Bio-rhythm cycle for intelligence, where horizontal display bar 45 represents an activated display segment and 45*a* represents an inactivated display segment. LCD area 44 also contains sixteen vertical display bars 4646*a* which are used to indicate the upward or downward direction of the cycle, where vertical display bar 46 represents an activated display segment and vertical display bar 46*a* represents an inactivated segment. Because there are thirty three days to the intelligence cycle the lower most of the horizontal display bars 45–45*a* is used to represent only one of the days of the cycle whereas the rest of the sixteen horizontal display bars 45–45*a* are each used to represent two of the days of the cycle. In LCD area 50 for the Bio-rhythm cycle for emotion are contained fourteen horizontal display bars 51–51*a* and thirteen vertical display bars 52–52*a* which function in the same manner as described above for the display bars 45–45*a* and 46–46*a* in LCD area 44 except that, in that there are twenty eight days to the emotional cycle, all fourteen horizontal display bars 51–51*a* are each used to represent two of the days of the cycle. In LCD area 53 for the Bio-rhythm cycle for the body are contained twelve horizontal display bars 54–54*a* and eleven vertical display bars 55–55*a* which also function in the same manner as described above for the display bars 45–45*a* and 46–46*a* in LCD area 44 and as with the horizontal display bars 45–45*a* the fact that there are twenty three days to the body cycle means that the lowest of the horizontal bars 54–54*a* is used to represent only one of the days of the cycle. None of the vertical display bars 46–46*a*,52–52*a*,55–55*a* are used when any of the cycles are at their peaks, i.e., day eight for the intelligence cycle, day seven for the emotional cycle, and day six for the body cycle, or when the emotional cycle is at its low point (day 21). The numbers 49*a* and markers 49*b* are used to indicate the particular day of a Bio-rhythm cycle. Critical line 56 is used to determine whether a Bio-rhythm cycle is in a positive phase, e.g, display bars 45 and 54, or in a negative phase, e.g., display bar 51. The LCD unit contained within the dotted lines 40 has lines 49,56, numbers 49*a*, markers 49*b* and words 49*c* printed on it in order to assist in clarifying the displayed information.

The circuitry for the second embodiment of the watch device functions in the same manner as that of the circuitry described above in FIG. 3 for the first embodiment, the only difference being that time in the first embodiment is indicated using an analog system and time in the second embodiment is indicated using an LCD system.

Description of the Third Embodiment

Figure 6:
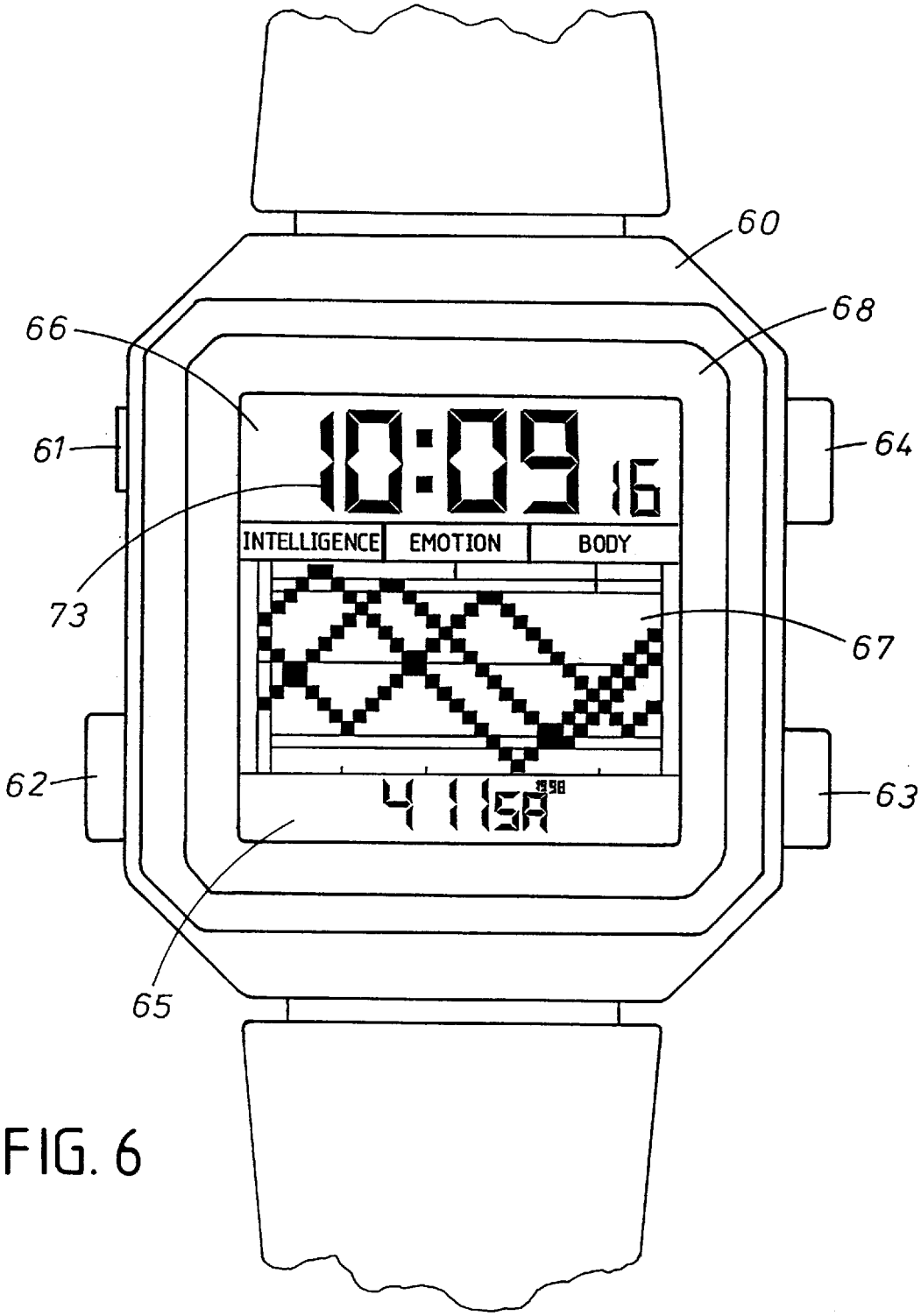
FIG. 6 is a front view of the third embodiment of the invention.

The watch device in FIG. 6 is comprised of a watch case 60 and lens 68. Initialization and setting of the time 73 in LCD area 66 is operated similarly to the above description for same in LCD area 36 of FIG. 4 by using the time button 61 for initialization and the input button 64 for setting. Control of the time options and information in LCD area 65 is similarly operated in the manner described above for LCD area 5 in FIG. 1 by using the mode button 63 to select the time options and the input button 62 to set each of the time options. In LCD area 67 are displayed the three Bio-rhythm cycles each represented as a sine curve for a thirty three day period. The three Bio-rhythm cycles are set by selecting the birth date option with the mode button 63 and then setting the desired birth date with the input button 62.

Figure 7:
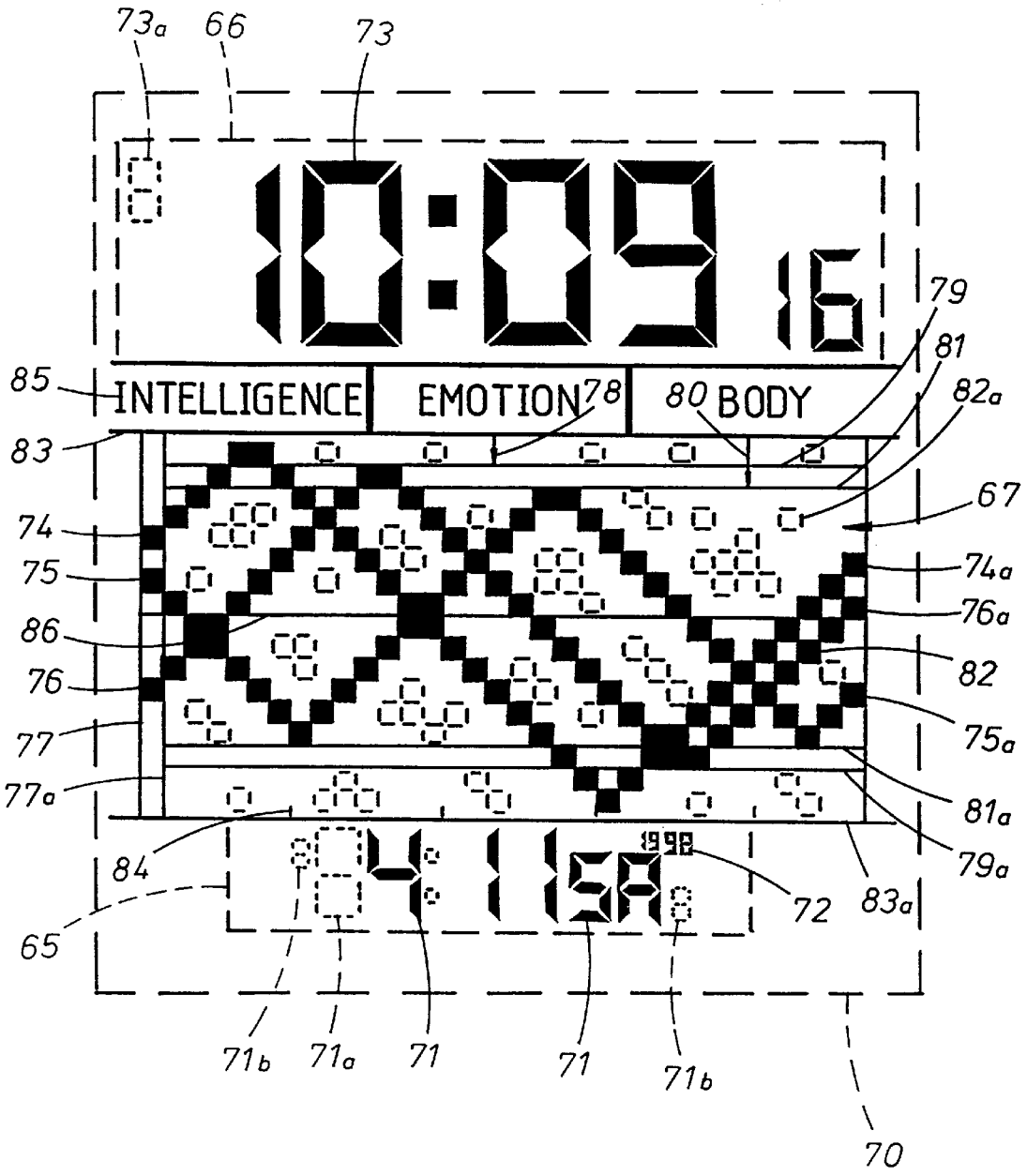
FIG. 7 is a detailed front view of the Bio-rhythm indicating graphic display of the third embodiment of the invention.

FIG. 7 is a detail of the LCD element contained within the dotted lines 70 for the third embodiment. The activated and inactivated display segments 71–72 in LCD area 65 operate in the same way as described above for the display segments 14–15 in LCD area 5 of FIG. 2. LCD area 66 contains time display segments 73–73*a* which are used to tell the time. LCD area 67 contains five hundred and sixty one display squares 82–82*a* where display square 82 represents an activated display square and display square 82*a* represents an inactivated display square. The Bio-rhythm cycle for intelligence is represented by the sine curve beginning with display square 74 and ending with display square 74*a*. The peak and low point of the intelligence sine curve are contained within lines 83 and 83*a*. The Bio-rhythm cycle for emotion is represented by the sine curve beginning with display square 76 and ending with display square 76*a*. The peak and low point of this curve are contained within lines 79 and 79*a*, and emotion indicator arrow 78 is used to highlight this relationship. The Bio-rhythm cycle for the body is represented by the sine curve beginning with display square 75 and ending with display square 75*a*. The peak and low point of this curve are contained within lines 81 and 81*a*, and the body indicator arrow 80 is used to highlight this relationship. Any display square which is contained within lines 77 and 77*a*, e.g., display squares 74–76, represents the daily position of one of the three Bio-rhythm cycles and changes its position each day as the particular Bio-rhythm sine curve it is a part of advances across LCD area 67 from right to left. Line 84 represents one week into the future of the three Bio-rhythm cycles which is useful for determining future Bio-rhythm positions and relationships. Critical line 86 is used to determine whether a Bio-rhythm cycle is in a positive phase, e.g, display squares 74 and 75, or in a negative phase, e.g., display square 76. All lines 77,77*a*,79, 79*a*,81,81*a*,83,83*a*,84,86, arrows 78,80, and words 85 are printed on the LCD element contained within the dotted lines 70.

Because the clarity of representing the three Bio-rhythm cycles as sine curves as illustrated in FIG. 7 may at times be obscured when the curves are close to each other or overlapping the third embodiment may also be composed using a color LCD which would enable greater accuracy when distinguishing between the three curves.

The circuitry for the third embodiment of the watch device functions in the same manner as that of the circuitry described above in FIG. 3 for the first embodiment, the only difference being that time in the first embodiment is indicated using an analog system and time in the third embodiment is indicated using an LCD system.

Description of the Fourth Embodiment

Figure 8:
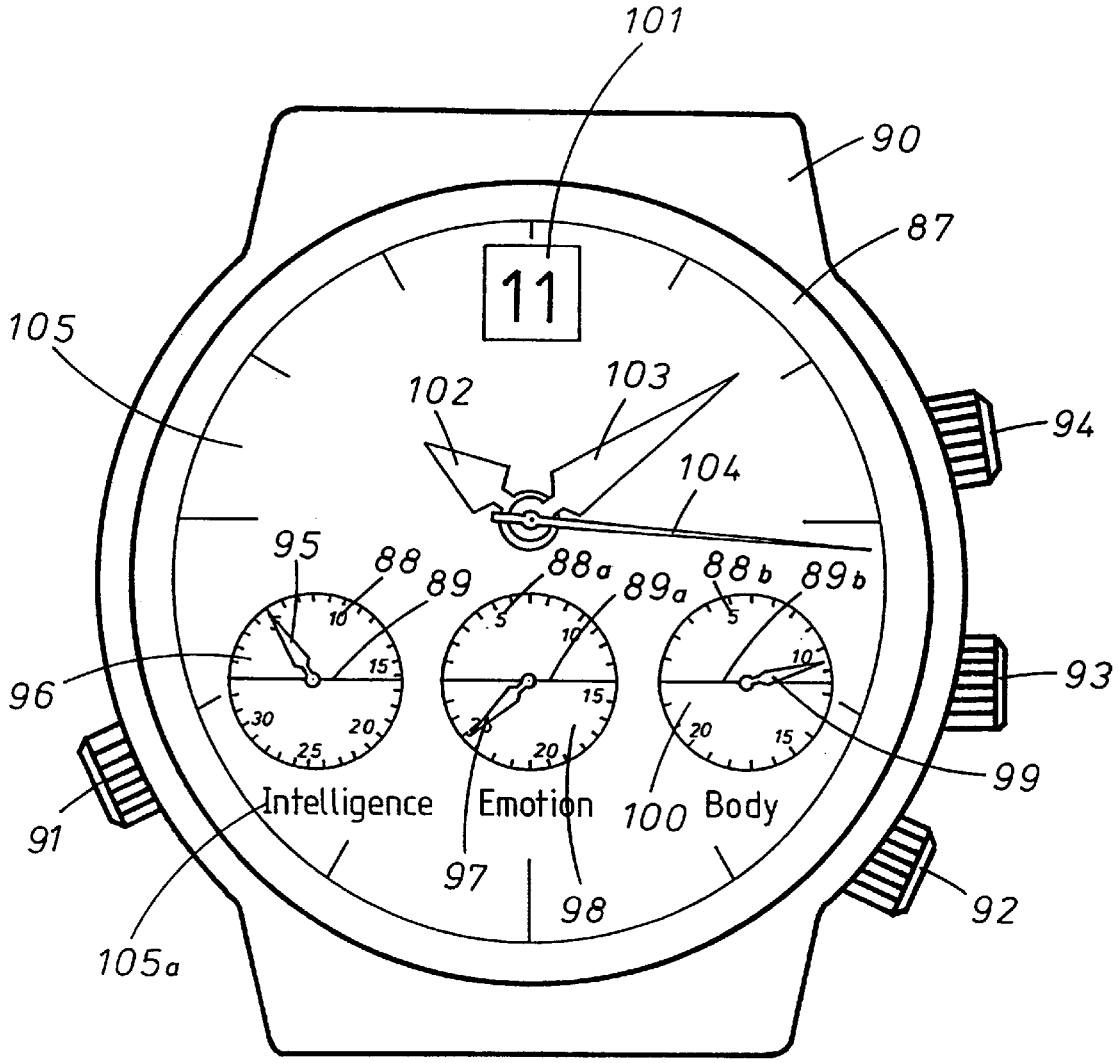
FIG. 8 is a front view of the fourth embodiment of the invention.

The watch device in FIG. 8 is an analog type device and is comprised of a watch case 90 and lens 87 which contain and protect all of the elements necessary for the operation of the device. Hour hand 102, minute hand 103, second hand 104 and date setting 101 are driven by a standard analog type watch movement. Hands 102–104 are positioned at a point eccentric from the center of the circumference of the base plate 105. Crown 94 operates control of the time position of the hands 102,103,104, and of the date setting 101. Crown 91 operates control of the positioning of the Bio-rhythm hand 95 for intelligence. Crown 92 operates control of the positioning of the Bio-rhythm hand 97 for emotion. Crown 93 operates control of the positioning of the Bio-rhythm hand 99 for the body. In display area 96 for intelligence are printed numbers 88 which represent the days of the intelligence Bio-rhythm cycle, and the critical line 89 which determines the positive or negative phase of the cycle. Similarly in display area 98 for emotion and display area 100 for the body are printed numbers 88*a*, 88*b* and the critical line 89*a*,89*b*. Words 105*a* are printed on the base plate 105. Because the watch device illustrated in FIG. 8 is entirely driven by an analog device it is necessary to set each of the Bio-rhythm display hands 95,97,99 individually by manual means. A user wanting to set the three Bio-rhythm positions relative to their own date of birth needs first to calculate the number of days from their own date of birth (including leap years) and to then divide this number by thirty three to obtain the correct position for intelligence, by twenty eight days to obtain the correct position for emotion, and by twenty three days to obtain the correct position for the body. Once set the three cycles are driven in unison by the watch movement, the mechanics of which are discussed below.

Figure 9:
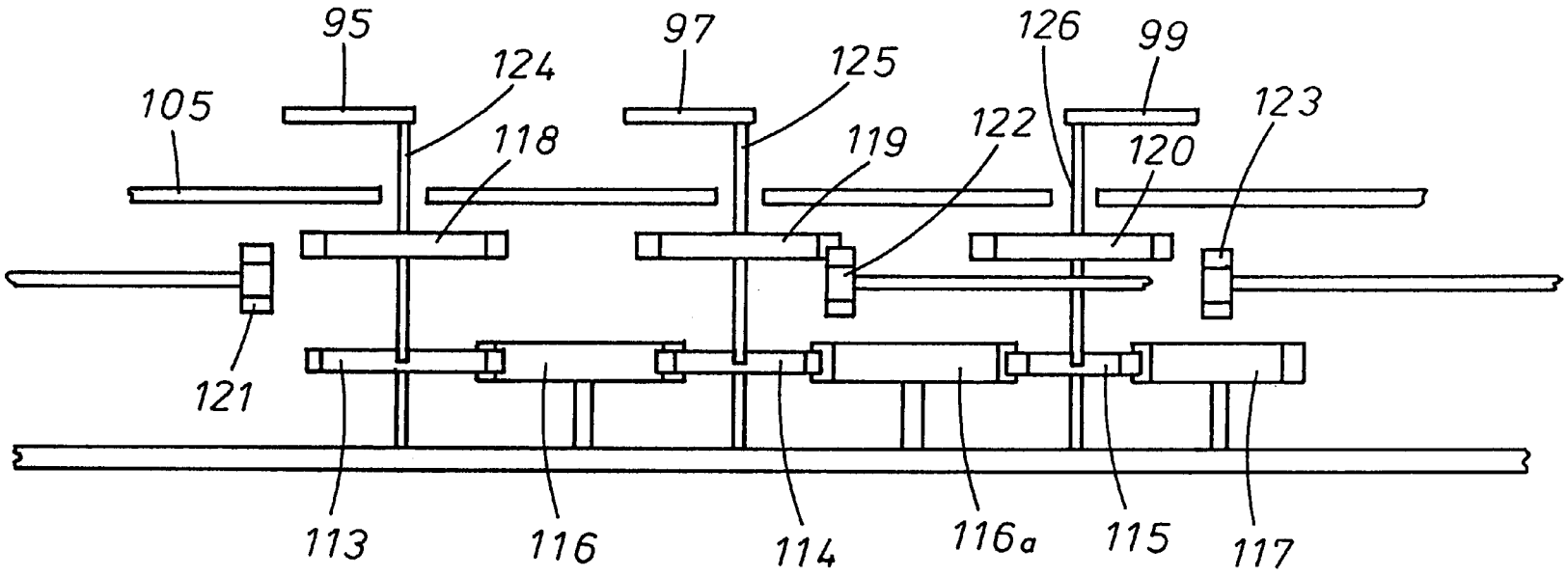
FIG. 9 is a cross sectional view of the gearing for the fourth embodiment of the invention.

FIG. 9 is an illustration of the gearing for operation and adjustment of the Bio-rhythm hands 95,97,99. Shaft 124 is affixed to adjustment gear 118 and is held by control gear 113. The contact between shaft 124 and control gear 113 is tight but moveable allowing that in normal use control gear 113 rotates shaft 124 as necessary but that slippage can occur between them when adjustment gear 121 is meshed with adjustment gear 118 for purposes of adjustment. Shafts 125 and 126 are similarly related to control gears 114 and 115. Adjustment of the three Bio-rhythm hands 95,97,99 involves moving the three adjustment gears 121,122,123, which are connected to the three crowns 91,92,93 in FIG. 8, inward until they are meshed with the three adjustment gears 118,119,120 at which point an adjustment rotation is possible. In FIG. 9 adjustment gears 119 and 122 are represented as being meshed with each other. To allow hands 95,97,99 to rotate in the required relationship of each cycle to the other, control gear 113 has thirty three teeth, control gear 114 has twenty eight teeth, and control gear 115 has twenty three teeth. Idler gears 116 and 1 16*a* have the same number of teeth. To compensate for the fact that the distance between control gears 113 and 114 is less than that between control gears 114 and 115, idler gear 116 is set slightly back from the alignment of control gears 113,114,115 and idler gear 116*a*. Operation of hands 95,97,99 is enacted by the watch movement (not shown) which rotates driver gear 117 one tooth per day which then rotates control gear 115, idler gear 166*a*, control gear 114, idler gear 116 and control gear 113 one tooth per day as each are sequentially meshed.

The specific embodiments of the invention as described above are representational of several forms of the invention as preferred to illustrate the possibilities for its embodiment and should not be considered as its to the potential for further embodiments which, within the scope of the invention, include numerous alternatives and modifications.

What I claim is:

1. A watch device, comprising:

display means or indicating time, time related information and biorhythm information wherein each of three biorhythm cycles is represented within its own rectangular area by a horizontal indicator bar which changes position to indicate the stage of the particular biorhythm cycle and which is accompanied or not accompanied by a vertical direction indicator bar; input means for inputing information regarding time, time related information and biorhythm information; memory means for storing time related information as is related to biorhythm information; control means for controlling the output of time, time related information and biorhythm information; calculating means for calculating time, time related information and biorhythm information as each type of information exists independently or is related to one or any of the other types of information.

2. A watch device, comprising:

display means for indicating time, time related information and biorhythm information wherein each of three biorhythm cycles is represented by its own sine curve which progresses across a stationary graph format as the stage of the cycle progresses; input means for inputing information regarding time, time related information and biorhythm information; memory means for storing time related information as is related to biorhythm information; control means for controlling the output of time, time related information and biorhythm information; calculating means for calculating time, time related information and biorhythm information as each type of information exists independently or is related to one or any of the other types or information.

3. A watch device as set forth in claim 2 wherein colors are used to represent biorhythm information.

* * * * *